US009989052B2

(12) United States Patent
Park et al.

(10) Patent No.: US 9,989,052 B2
(45) Date of Patent: Jun. 5, 2018

(54) LINEAR COMPRESSOR AND METHOD OF MANUFACTURING A LINEAR COMPRESSOR

(71) Applicant: LG ELECTRONICS INC., Seoul (KR)

(72) Inventors: Joonsung Park, Seoul (KR); Donghan Kim, Seoul (KR); Byungju Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 478 days.

(21) Appl. No.: 14/643,068

(22) Filed: Mar. 10, 2015

(65) Prior Publication Data

US 2015/0369238 A1 Dec. 24, 2015

(30) Foreign Application Priority Data

Jun. 24, 2014 (KR) ..... 10-2014-0077508

(51) Int. Cl.
*F04B 53/00* (2006.01)
*F04B 39/00* (2006.01)
(Continued)

(52) U.S. Cl.
CPC ..... *F04B 53/14* (2013.01); *C23C 28/32* (2013.01); *C23C 28/343* (2013.01);
(Continued)

(58) Field of Classification Search
CPC .... F04B 53/14; F04B 35/045; F04B 39/0005; C23C 28/343; C23C 28/32; F05C 2253/12; Y10T 28/49238
See application file for complete search history.

(56) References Cited

U.S. PATENT DOCUMENTS 5,480,231 A * 1/1996 Sasaki ..... F16C 33/12 384/206
9,650,986 B2 * 5/2017 Uehara ..... F02F 1/18
(Continued)

FOREIGN PATENT DOCUMENTS

KR 10-1307688 B1 9/2013
WO WO 2009/157267 12/2009

OTHER PUBLICATIONS

European Search Report dated Feb. 8, 2016.
European Search Report dated Sep. 11, 2017.

*Primary Examiner* — Dustin T Nguyen
(74) *Attorney, Agent, or Firm* — Ked & Associates LLP

(57) ABSTRACT

A linear compressor and a method of manufacturing a linear compressor are provided. The linear compressor may include a shell including a suction inlet, a cylinder having a compression space, in which a refrigerant suctioned in through the suction inlet may be compressed, a piston reciprocated within the cylinder, a first surface treatment disposed on an outer surface of the piston, the first surface treatment having a first hardness value, which is a measured hardness value, and a buffer disposed between the outer surface of the piston and the first surface treatment. The buffer may have a second hardness value, which is a measured hardness value. The first hardness value of the first surface treatment may be greater than the second hardness value of the buffer.

9 Claims, 14 Drawing Sheets

(51) Int. Cl.

| | |
|---|---|
| ***F04B 37/00*** | (2006.01) |
| ***F04B 53/14*** | (2006.01) |
| ***F04B 35/04*** | (2006.01) |
| ***C23C 28/00*** | (2006.01) |

(52) U.S. Cl.
CPC ..... *F04B 35/045* (2013.01); *F04B 39/0005* (2013.01); *F05C 2253/12* (2013.01); *Y10T 29/49238* (2015.01)

(56) References Cited

U.S. PATENT DOCUMENTS

| | | | | |
|---|---|---|---|---|
| 2002/0046647 | A1* | 4/2002 | Sugiura | F01B 3/00 92/71 |
| 2008/0000348 | A1 | 1/2008 | Schubert et al. | |
| 2009/0176035 | A1* | 7/2009 | Tudhope | C23C 16/045 427/576 |
| 2010/0159271 | A1 | 6/2010 | Sugioka et al. | |
| 2011/0044828 | A1* | 2/2011 | Lund | F04B 9/06 417/362 |
| 2013/0058815 | A1 | 3/2013 | Kim | |

* cited by examiner

LINEAR COMPRESSOR AND METHOD OF MANUFACTURING A LINEAR COMPRESSOR

CROSS-REFERENCE TO RELATED APPLICATION(S)

The present application claims priority under 35 U.S.C. 119 and 35 U.S.C. 365 to Korean Patent Application No. 10-2014-0077508, filed in Korea on Jun. 24, 2014, which is hereby incorporated by reference in its entirety.

BACKGROUND

1. Field

A linear compressor and a method of manufacturing a linear compressor are disclosed herein.

2. Background

Cooling systems are systems in which a refrigerant is circulated to generate cool air. In such a cooling system, processes of compressing, condensing, expanding, and evaporating the refrigerant may be repeatedly performed. For this, the cooling system may include a compressor, a condenser, an expansion device, and an evaporator. The cooling system may be installed in a refrigerator or air conditioner, which is a home appliance.

In general, compressors are machines that receive power from a power generation device, such as an electric motor or turbine, to compress air, a refrigerant, or various working gases, thereby increasing in pressure. Compressors are being widely used in home appliances or industrial fields.

Compressors may be largely classified into reciprocating compressors, in which a compression space into and from which a working gas is suctioned and discharged, is defined between a piston and a cylinder to allow the piston to be linearly reciprocated in the cylinder, thereby compressing the working gas; rotary compressors, in which a compression space into and from which a working gas is suctioned or discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned or discharged, is defined between an orbiting scroll and a fixed scroll to compress the working gas while the orbiting scroll rotates along the fixed scroll. In recent years, a linear compressor, which is directly connected to a drive motor, in which a piston is linearly reciprocated, to improve compression efficiency without mechanical losses due to movement conversion and has a simple structure, is being widely developed.

The linear compressor may suction and compress a working gas, such as a refrigerant, while the piston is linearly reciprocated in a sealed shell by a linear motor, and then discharge the working gas. The linear motor may include a permanent magnet disposed between an inner stator and an outer stator. The permanent magnet may be linearly reciprocated by an electromagnetic force between the permanent magnet and the inner (or outer) stator. As the permanent magnet operates in a state in which the permanent magnet is connected to the piston, the refrigerant may be suctioned and compressed while the piston is linearly reciprocated within the cylinder, and then, may be discharged.

The present Applicant filed a patent (hereinafter, referred to as a "prior document") and then registered the patent with respect to the linear compressor, as Korean Patent No 10-1307688, filed on Sep. 5, 2013 and entitled "linear compressor", which is hereby incorporated by reference. The linear compressor according to the prior art document includes a shell that accommodates a plurality of components. A vertical height of the shell may be somewhat high, as illustrated in the prior art document. An oil supply assembly to supply oil between a cylinder and a piston may be disposed within the shell.

When the linear compressor is provided in a refrigerator, the linear compressor may be disposed in a machine chamber provided at a rear side of the refrigerator. In recent years, a major concern of customers is increasing an inner storage space of the refrigerator. To increase the inner storage space of the refrigerator, it may be necessary to reduce a volume of the machine room. To reduce the volume of the machine room, it may be important to reduce a size of the linear compressor.

However, as the linear compressor disclosed in the prior art document has a relatively large volume, the linear compressor is not applicable to a refrigerator, for which increased inner storage space is sought. To reduce the size of the linear compressor, it may be necessary to reduce a size of a main component of the compressor. In this case, a performance of the compressor may deteriorate.

To compensate for the deteriorated performance of the compressor, it may be necessary to increase to a drive frequency of the compressor. However, the more the drive frequency of the compressor is increased, the more a friction force due to oil circulating in the compressor increases, deteriorating performance of the compressor.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
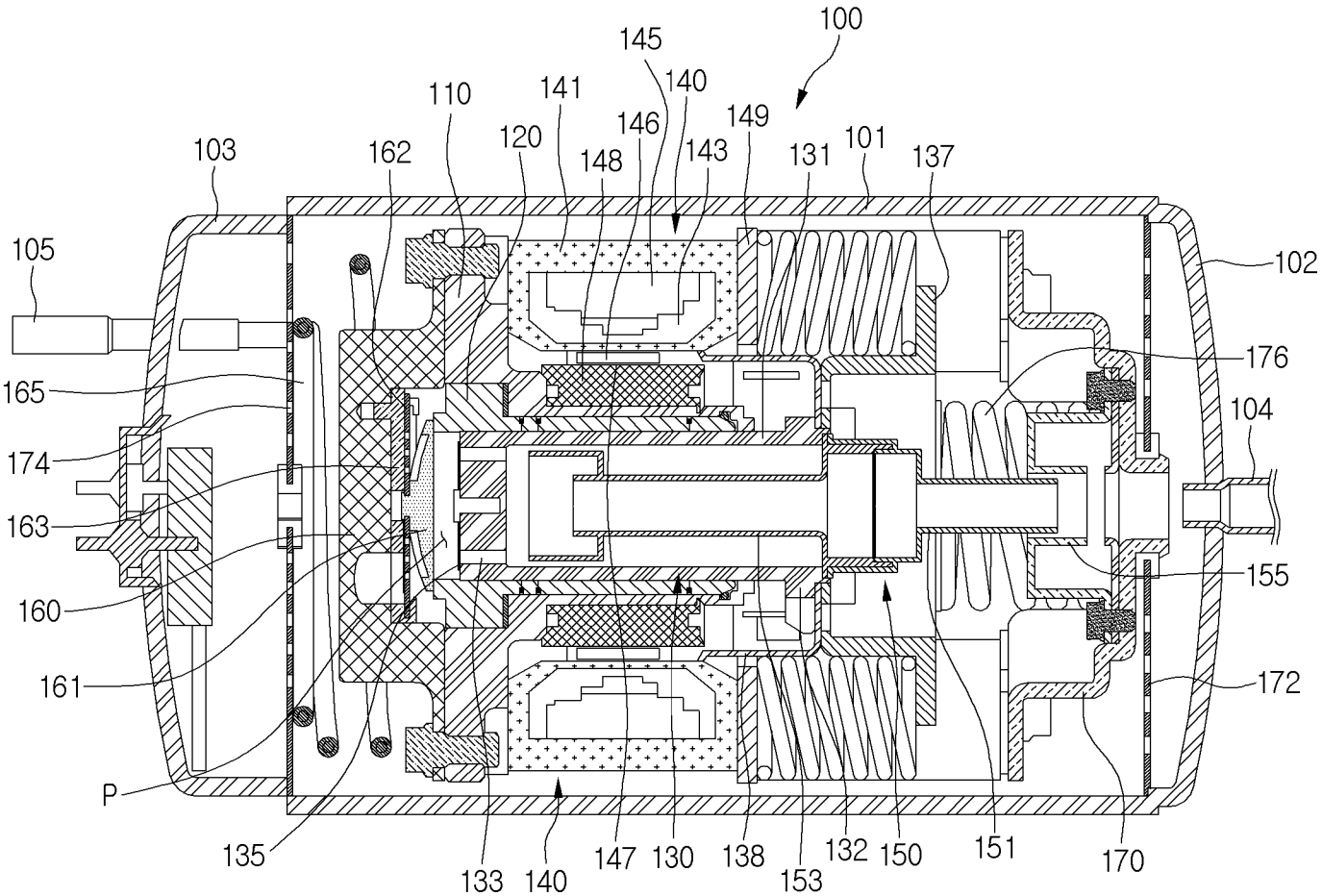
FIG. 1 is a cross-sectional view of a linear compressor according to an embodiment.

FIG. 1 is a cross-sectional view of a linear compressor according to an embodiment. Referring to FIG. 1, the linear compressor 100 according to an embodiment may include a shell 101 having an approximately cylindrical shape, a first cover 102 coupled to one or a first side of the shell 101, and a second cover 103 coupled to the other or a second side of the shell 101. For example, the linear compressor 100 may be laid out in a horizontal direction. The first cover 102 may be coupled to a right or first lateral side of the shell 101, and the second cover 103 may be coupled to a left or second lateral side of the shell 101. Each of the first and second covers 102 and 103 may be understood as one component of the shell 101.

The linear compressor 100 may include a cylinder 120 provided in the shell 101, a piston 130 linearly reciprocated within the cylinder 120, and a motor assembly 140 that serves as a linear motor to apply a drive force to the piston 130. When the motor assembly 140 operates, the piston 130 may be linearly reciprocated at a high rate. The linear compressor 100 according to this embodiment may have a drive frequency of about 100 Hz.

In detail, the linear compressor 100 may include a suction inlet 104, through which the refrigerant may be introduced, and a discharge outlet 105, through which the refrigerant compressed in the cylinder 120 may be discharged. The suction inlet 104 may be coupled to the first cover 102, and the discharge outlet 105 may be coupled to the second cover 103.

The refrigerant suctioned in through the suction inlet 104 may flow into the piston 130 via a suction muffler 150. While the refrigerant passes through the suction muffler 150, noise may be reduced. The suction muffler 150 may be configured by coupling a first muffler 151 to a second muffler 153. At least a portion of the suction muffler 150 may be disposed within the piston 130.

The piston 130 may include a piston body 131 having an approximately cylindrical shape, and a piston flange 132 that extends from the piston body 131 in a radial direction. The piston body 131 may be reciprocated within the cylinder 120, and the piston flange 132 may be reciprocated outside of the cylinder 120.

The piston 130 may be formed of a nonmagnetic material, such as an aluminum material, such as aluminum or an aluminum alloy. As the piston 130 is formed of the aluminum material, a magnetic flux generated in the motor assembly 140 may not be transmitted into the piston 130, and thus, may be prevented from leaking outside of the piston 130. Also, as the piston 130 has a low weight, the piston 130 may be easily reciprocated. The piston 130 may be manufactured by a forging process, for example.

The cylinder 120 may be formed of a nonmagnetic material, such as an aluminum material, such as aluminum or an aluminum alloy. Also, the cylinder 120 and the piston 130 may have a same material composition, that is, a same kind and composition.

As the cylinder 120 may be formed of the aluminum material, a magnetic flux generated in the motor assembly 200 may not be transmitted into the cylinder 120, and thus, may be prevented from leaking outside of the cylinder 120. The cylinder 120 may be manufactured by an extruding rod processing process, for example.

As the piston 130 may be formed of the same material (aluminum) as the cylinder 120, the piston 130 may have a same thermal expansion coefficient as the cylinder 120. When the linear compressor 100 operates, an high-temperature (a temperature of about 100° C.) environment may be created within the shell 100. Thus, as the piston 130 and the cylinder 120 have the same thermal expansion coefficient, the piston 130 and the cylinder 120 may be thermally deformed by a same degree. As a result, the piston 130 and the cylinder 120 may be thermally deformed with sizes and in directions different from each other to prevent the piston 130 from interfering with the cylinder 120 while the piston 430 moves.

The cylinder 120 may accommodate at least a portion of the suction muffler 150 and at least a portion of the piston 130. The cylinder 120 may have a compression space P, in which the refrigerant may be compressed by the piston 130. A suction hole 133, through which the refrigerant may be introduced into the compression space P, may be defined in or at a front portion of the piston 130, and a suction valve 135 to selectively open the suction hole 133 may be disposed on or at a front side of the suction hole 133. A coupling hole, to which a predetermined coupling member may be coupled, may be defined in an approximately central portion of the suction valve 135.

A discharge cover 160 that defines a discharge space or discharge passage for the refrigerant discharged from the compression space P, and a discharge valve assembly 160, 162, and 163 coupled to the discharge cover 160 to selectively discharge the refrigerant compressed in the compression space P may be provided at a front side of the compression space P. The discharge valve assembly 161, 162, and 163 may include a discharge valve 161 to introduce the refrigerant into the discharge space of the discharge cover 160 when a pressure within the compression space P is above a predetermined discharge pressure, a valve spring 162 disposed between the discharge valve 161 and the discharge cover 160 to apply an elastic force in an axial direction, and a stopper 163 that restricts deformation of the valve spring 162.

The term "compression space P" may refer to a space defined between the suction valve 135 and the discharge valve 161. The suction valve 135 may be disposed on one or a first side of the compression space P, and the discharge valve 161 may be disposed on the other or a second side of the compression space P, that is, a side opposite of the suction valve 135.

Figure 3:
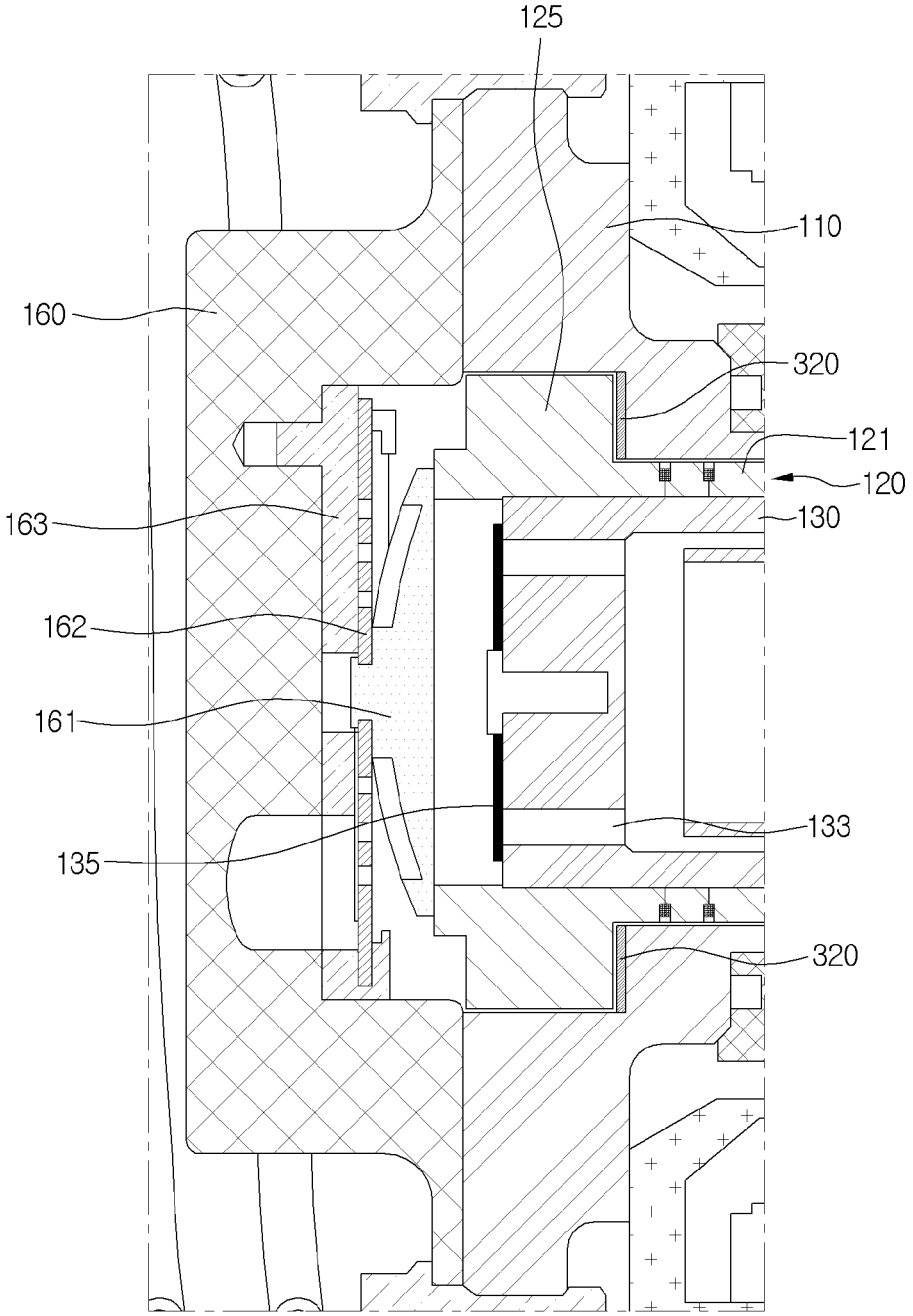
FIG. 3 is a cross-sectional view illustrating a position of a second filter according to an embodiment.

The term "axial direction" may refer to a direction in which the piston 130 is reciprocated, that is, a transverse direction in FIG. 3. In the axial direction, a direction from the suction inlet 104 toward the discharge outlet 105, that is, a direction in which the refrigerant flows may be defined as a "frontward direction", and a direction opposite to the frontward direction may be defined as a "rearward direction". On the other hand, the term "radial direction" may refer to a direction perpendicular to the direction in which the piston 130 is reciprocated, that is, a horizontal direction in FIG. 1.

The stopper 163 may be seated on the discharge cover 160, and the valve spring 162 may be seated at a rear side of the stopper 163. The discharge valve 161 may be coupled to the valve spring 162, and a rear portion or rear surface of the discharge valve 161 may be supported by a front surface of the cylinder 120. The valve spring 162 may include a plate spring, for example.

While the piston 130 is linearly reciprocated within the cylinder 120, when the pressure of the compression space P is below the predetermined discharge pressure and a predetermined suction pressure, the suction valve 135 may be opened to suction the refrigerant into the compression space P. On the other hand, when the pressure of the compression space P is above the predetermined suction pressure, the refrigerant may be compressed in the compression space P in a state in which the suction valve 135 is closed.

When the pressure of the compression space P is above the predetermined discharge pressure, the valve spring 162 may be deformed to open the discharge valve 161. The refrigerant may be discharged from the compression space P into the discharge space of the discharge cover 160.

The refrigerant flowing into the discharge space of the discharge cover 160 may be introduced into a loop pipe 165. The loop pipe 165 may be coupled to the discharge cover 160 to extend to the discharge outlet 105, thereby guiding the compressed refrigerant in the discharge space into the discharge outlet 105. For example, the loop pipe 165 may have a shape that is wound in a predetermined direction and extends in a rounded shape. The loop pipe 165 may be coupled to the discharge outlet 105.

The linear compressor 100 may further include a frame 110 coupled to an outside of the cylinder 120. The frame 110 may fix the cylinder 120 and be coupled to the cylinder 200 by a separate coupling member, for example. The frame 110 may be disposed to surround the cylinder 120. That is, the cylinder 120 may be accommodated within the frame 110. The discharge cover 160 may be coupled to a front surface of the frame 110.

At least a portion of the high-pressure gas refrigerant discharged through the opened discharge valve 161 may flow toward an outer circumferential surface of the cylinder 120 through a space at a portion at which the cylinder 120 and the frame 110 are coupled to each other. The refrigerant may be introduced into the cylinder 120 through one or more gas inflow (see reference numeral 122 of FIG. 7) and one or more nozzle (see reference numeral 123 of FIG. 7), which may be defined in the cylinder 120. The introduced refrigerant may flow into a space defined between the piston 130 and the cylinder 120 to allow an outer circumferential surface of the piston 130 to be spaced apart from an inner circumferential surface of the cylinder 120. Thus, the introduced refrigerant may serve as a "gas bearing" that reduces friction between the piston 130 and the cylinder 120 while the piston 130 is reciprocated.

The motor assembly 140 may include outer stators 141, 143, and 145 fixed to the frame 110 and disposed to surround the cylinder 120, an inner stator 148 disposed to be spaced inward from the outer stators 141, 143, and 145, and a permanent magnet 146 disposed in a space between the outer stators 141, 143, and 145 and the inner stator 148. The permanent magnet 146 may be linearly reciprocated by a mutual electromagnetic force between the outer stators 141, 143, and 145 and the inner stator 148. The permanent magnet 146 may be a single magnet having one polarity, or a plurality of magnets having three polarities.

The permanent magnet 146 may be coupled to the piston 130 by a connection member 138, for example. In detail, the connection member 138 may be coupled to the piston flange 132 and be bent to extend toward the permanent magnet 146. As the permanent magnet 146 is reciprocated, the piston 130 may be reciprocated together with the permanent magnet 146 in the axial direction.

The motor assembly 140 may further include a fixing member 147 to fix the permanent magnet 146 to the connection member 138. The fixing member 147 may be formed of a composition in which a glass fiber or carbon fiber is mixed with a resin. The fixing member 147 may be provided to surround an outside of the permanent magnet 146 to firmly maintain a coupled state between the permanent magnet 146 and the connection member 138.

The outer stators 141, 143, and 145 may include coil winding bodies 143 and 145, and a stator core 141. The coil winding bodies 143 and 145 may include a bobbin 143, and a coil 145 wound in a circumferential direction of the bobbin 145. The coil 145 may have a polygonal cross-section, for example, a hexagonal cross-section. The stator core 141 may be manufactured by stacking a plurality of laminations in a circumferential direction and be disposed to surround the coil winding bodies 143 and 145.

A stator cover 149 may be disposed on or at one side of the outer stators 141, 143, and 145. One or a first side of the outer stators 141, 143, and 145 may be supported by the frame 110, and the other or a second side of the outer stators 141, 143, and 145 may be supported by the stator cover 149.

The inner stator 148 may be fixed to a circumference of the frame 110. Also, in the inner stator 148, a plurality of laminations may be stacked in a circumferential direction outside of the frame 110.

The linear compressor 100 may further include a support 137 that supports the piston 130, and a back cover 170 spring-coupled to the support 137. The support 137 may be coupled to the piston flange 132 and the connection member 138 by a predetermined coupling member, for example.

A suction guide 155 may be coupled to a front portion of the back cover 170. The suction guide 155 may guide the refrigerant suctioned through the suction inlet 104 to introduce the refrigerant into the suction muffler 150.

The linear compressor 100 may include a plurality of springs 176, which are adjustable in natural frequency, to allow the piston 130 to perform a resonant motion. The plurality of springs 176 may include a first spring supported between the support 137 and the stator cover 149, and a second spring supported between the support 137 and the back cover 170.

The linear compressor 100 may further include plate springs 172 and 174, respectively, disposed on or at first and second lateral sides or ends of the shell 101 to allow inner components of the compressor 100 to be supported by the shell 101. The plate springs 172 and 174 may include a first plate spring 172 coupled to the first cover 102, and a second plate spring 174 coupled to the second cover 103. For example, the first plate spring 172 may be fitted into a portion at which the shell 101 and the first cover 102 are coupled to each other, and the second plate spring 174 may be fitted into a portion at which the shell 101 and the second cover 103 are coupled to each other.

Figure 2:
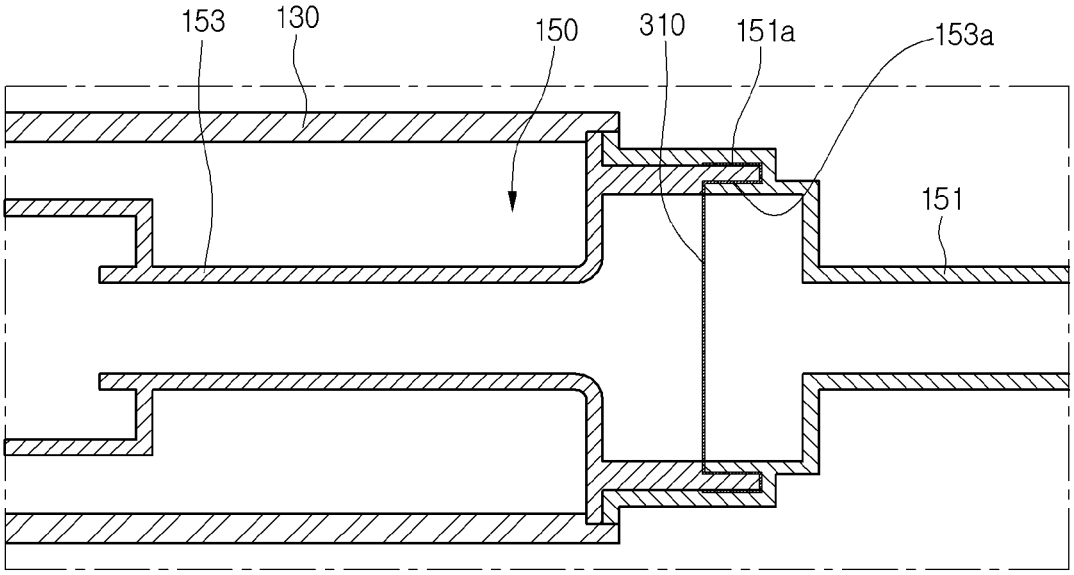
FIG. 2 is a cross-sectional view of a suction muffler according to an embodiment.

FIG. 2 is a cross-sectional view of a suction muffler according to an embodiment. Referring to FIG. 2, the suction muffler 150 according to this embodiment may include the first muffler 151, the second muffler 153 coupled to the first muffler 151, and a first filter 310 supported by the first and second mufflers 151 and 153.

A flow space, in which the refrigerant may flow, may be defined in each of the first and second mufflers 151 and 153. The first muffler 151 may extend from an inside of the suction inlet 104 in a direction of the discharge outlet 105, and at least a portion of the first muffler 151 may extend inside of the suction guide 155. The second muffler 153 may extend from the first muffler 151 to the inside of the piston body 131.

The first filter 310 may be disposed in the flow space to filter foreign substances. The first filter 310 may be formed of a material having a magnetic property. Thus, foreign substances contained in the refrigerant, in particular, metallic substances, may be easily filtered. The first filter 310 may be formed of stainless steel, for example, and thus, have a magnetic property to prevent the first filter 310 from rusting. As another example, the first filter 310 may be coated with a magnetic material, or a magnet may be attached to a surface of the first filter 310.

The first filter 310 may be a mesh-type structure and have an approximately circular plate shape. Each filter hole of the first filter 310 may have a diameter or width less than a predetermined diameter or width. For example, the predetermined size may be about 25 μm.

The first muffler 151 and the second muffler 153 may be assembled with each other using a press-fit manner, for example. The first filter 310 may be fitted into a portion at which the first and second mufflers 151 and 153 are press-fitted together, and then, may be assembled. For example, a groove 151*a* may be provided in one of the first muffler 151 or the second muffler 153, and a protrusion 153*a* to be inserted into the groove 151*a* may be provided on the other one of the first muffler 151 or second muffler 153.

The first filter 310 may be supported by the first and second mufflers 151 and 153 in a state in which both sides of the first filter 310 are disposed between the groove 151*a* and the protrusion 153*a*. In a state in which the first filter 310 is disposed between the first muffler 151 and the second muffler 153, when the first and second mufflers 151 and 153 move in a direction that approach each other and then are press-fitted together, both sides of the first filter 310 may be inserted and fixed between the groove 151*a* and the protrusion 153*a*.

As described above, as the first filter 310 may be provided on the suction muffler 150, a foreign substance having a size greater than a predetermined size in the refrigerant suctioned in through the suction inlet 104 may be filtered by the first filter 310. Thus, the first filter 310 may filter the foreign substance from the refrigerant acting as the gas bearing between the piston 130 and the cylinder 120 to prevent the foreign substance from being introduced into the cylinder 120.

Also, as the first filter 310 may be firmly fixed to the portion at which the first and second mufflers 151 and 153 are press-fitted together, separation of the first filter 310 from the suction muffler 150 may be prevented.

Figure 4:
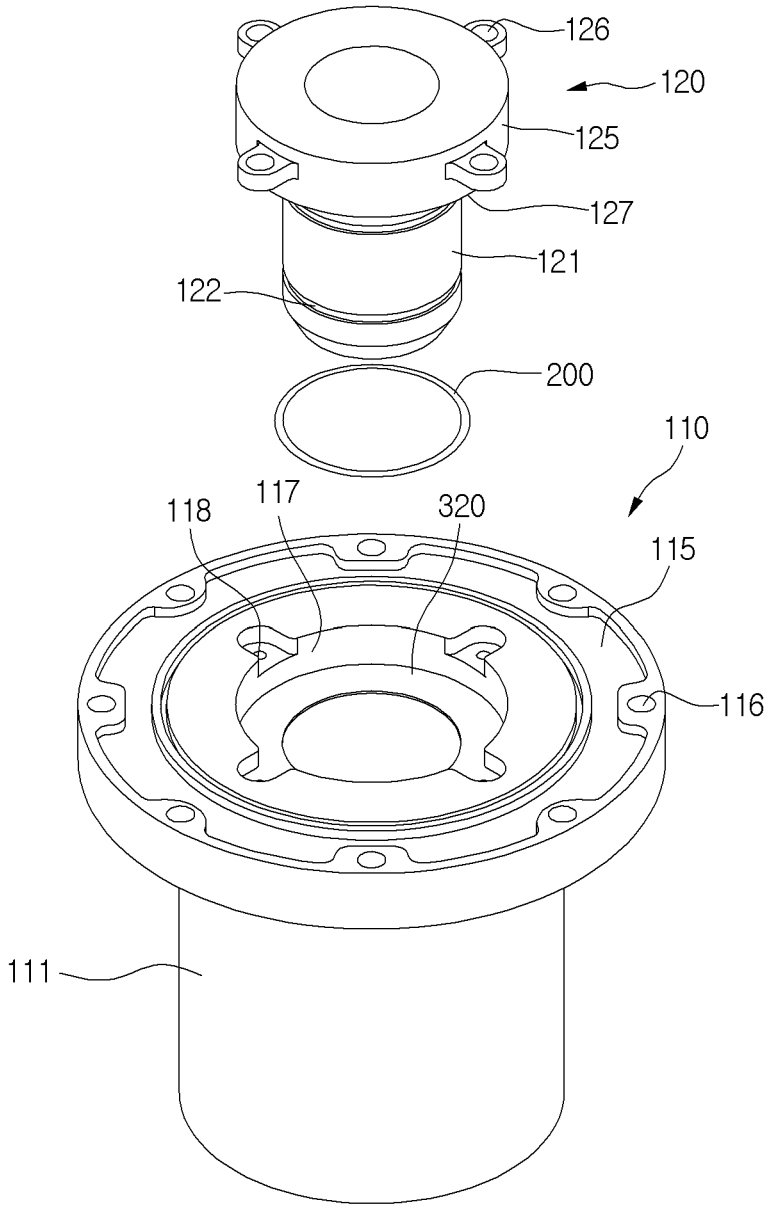
FIG. 4 is an exploded perspective view of a cylinder and a frame according to an embodiment.

FIG. 3 is a cross-sectional view illustrating a position of a second filter according to an embodiment. FIG. 4 is an exploded perspective view of a cylinder and a frame according to an embodiment.

Referring to FIGS. 3 and 4, the linear compressor 100 according to an embodiment may include a second filter 320 disposed between the frame 110 and the cylinder 120 to filter a high-pressure gas refrigerant discharged through the discharge valve 161. The second filter 320 may be disposed on a portion of a coupled surface at which the frame 110 and the cylinder 120 are coupled to each other.

In detail, the cylinder 120 may include a cylinder body 121 having an approximately cylindrical shape, and cylinder flange 125 that extends from the cylinder body 121 in a radial direction. The cylinder body 121 may include the one or more gas inflow 122, through which the discharged gas refrigerant may be introduced. The gas inflow 122 may be recessed in an approximately circular shape along a circumferential surface of the cylinder body 121.

A plurality of the gas inflow 122 may be provided. The plurality of gas inflows 122 may include gas inflows (see reference numerals 122*a* and 122*b* of FIG. 6) disposed on one or a first side with respect to a center or central portion 121*c* of the cylinder body 121 in an axial direction, and a gas inflow (see reference numeral 122*c* of FIG. 6) disposed on the other or a second side with respect to the center or central portion 121*c* of the cylinder body 121 in the axial direction.

One or more coupling portion 126 coupled to the frame 110 may be disposed on the cylinder flange 125. Each coupling portion 126 may protrude outward from an outer circumferential surface of the cylinder flange 125. Each coupling portion 126 may be coupled to a cylinder coupling hole 118 of the frame 110 by a predetermined coupling member, for example.

The cylinder flange 125 may have a seat surface 127 seated on the frame 110. The seat surface 127 may be a rear surface of the cylinder flange 125 that extends from the cylinder body 121 in the radial direction.

The frame 110 may include a frame body 111 that surrounds the cylinder body 121, and a cover coupling portion 115 that extends in a radial direction of the frame body 121 and is coupled to the discharge cover 160. The cover coupling portion 115 may have a plurality of cover coupling holes 116, in which the coupling member coupled to the discharge cover 160 may be inserted, and a plurality of the cylinder coupling hole 118, in which the coupling member coupled to the cylinder flange 125 may be inserted. The plurality of cylinder coupling holes 118 may be defined at positions raised somewhat from the cover coupling portion 115.

The frame 110 may have a recess 117 recessed backward from the cover coupling portion 115 to allow the cylinder flange 125 to be inserted therein. That is, the recess 117 may be disposed to surround the outer circumferential surface of the cylinder flange 125. The recess 117 may have a recessed depth corresponding to a front/rear width of the cylinder flange 125.

A predetermined refrigerant flow space may be defined between an inner circumferential surface of the recess 117 and the outer circumferential surface of the cylinder flange 125. The high-pressure gas refrigerant discharged from the discharge valve 161 may flow toward the outer circumferential surface of the cylinder body 121 via the refrigerant flow space. The second filter 320 may be disposed in the refrigerant flow space to filter the refrigerant.

In detail, a seat having a stepped portion may be disposed on or at a rear end of the recess 117. The second filter 320, which may have a ring shape, may be seated on the seat.

In a state in which the second filter 320 is seated on the seat, when the cylinder 120 is coupled to the frame 110, the cylinder flange 125 may push the second filter 320 from a front side of the second filter 320. That is, the second filter 320 may be disposed and fixed between the seat of the frame 110 and the seat surface 127 of the cylinder flange 125.

The second filter 320 may prevent foreign substances in the high-pressure gas refrigerant discharged through the opened discharge valve 161 from being introduced into the gas inflow 122 of the cylinder 120 and be configured to adsorb oil contained in the refrigerant thereon or therein. For example, the second filter 320 may include a felt formed of polyethylene terephthalate (PET) fiber or an adsorbent paper. The PET fiber may have superior heat-resistance and mechanical strength. Also, a foreign substance having a size of about 2 μm or more, which is contained in the refrigerant, may be blocked.

The high-pressure gas refrigerant passing through the flow space defined between the inner circumferential surface of the recess 117 and the outer circumferential surface of the cylinder flange 125 may pass through the second filter 320. In this process, the refrigerant may be filtered by the second filter 320.

The linear compressor 100 may further include a sealing member 200 disposed between the outer circumferential surface of the cylinder body 121 and an inner circumferential surface of the frame body 111 to seal a space between the cylinder 120 and the frame 110. A sealing pocket (see reference numeral 220 of FIG. 8) may be provided between the outer circumferential surface of the cylinder body 121 and the inner circumferential surface of the frame body 111.

The sealing member 200 may have a ring shape, that is, an O-ring shape. The sealing member 200 may be disposed to surround an outer circumference of a first inclined portion (see reference numeral 128 of FIG. 6) provided on or at a rear side of the cylinder body 121 and be movable along the first inclined portion 128.

Figure 5:
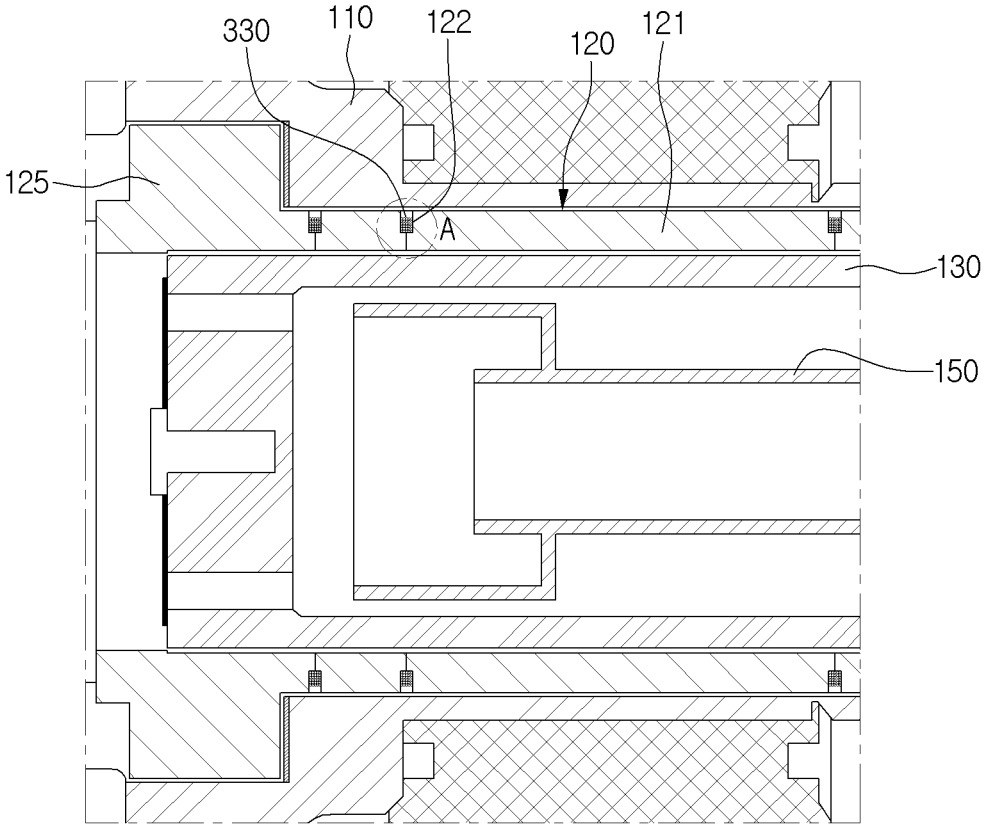
FIG. 5 is a cross-sectional view illustrating a state in which the cylinder and a piston are coupled to each other according to an embodiment.
Figure 6:
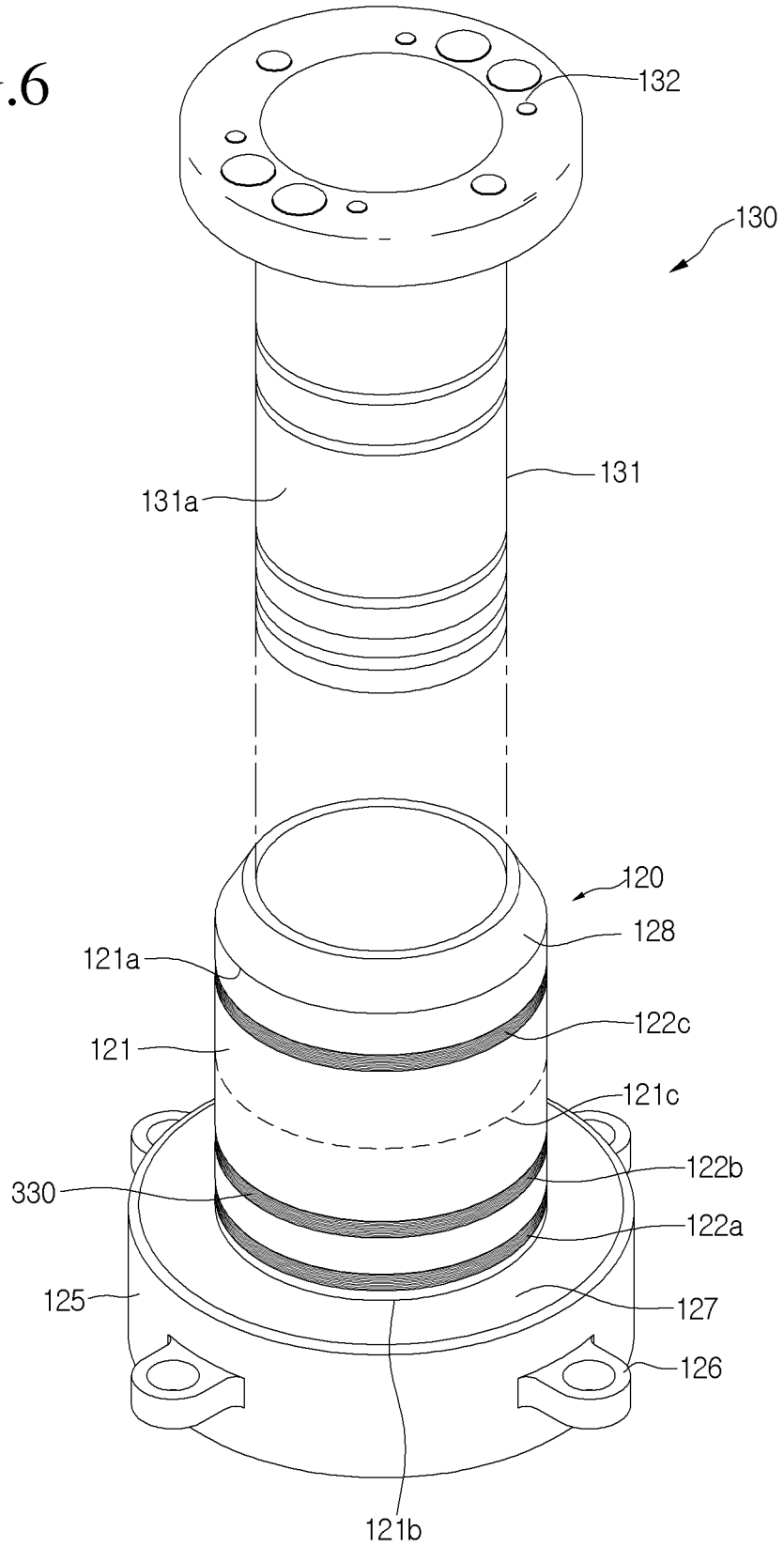
FIG. 6 is an exploded perspective view of the cylinder and the piston according to an embodiment.
Figure 7:
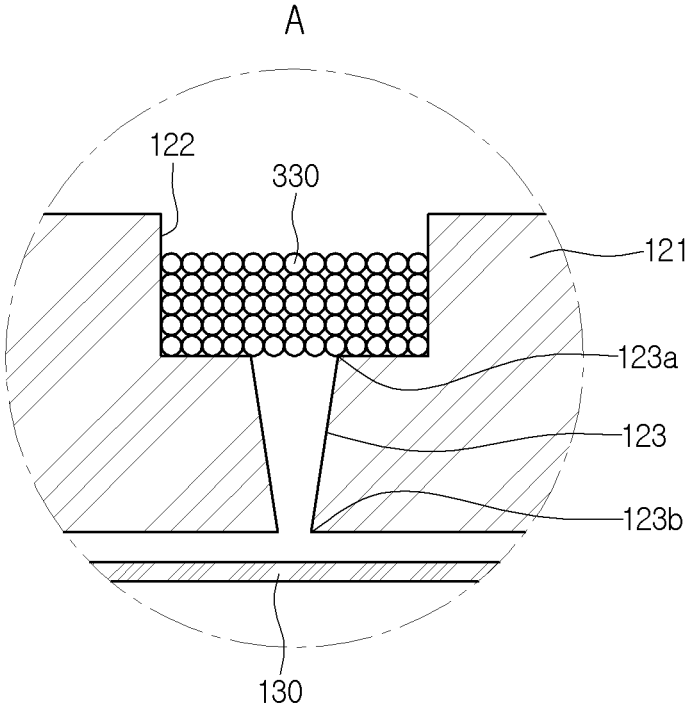
FIG. 7 is an enlarged view of portion A of FIG. 5.

FIG. 5 is a cross-sectional view illustrating a state in which the cylinder and a piston are coupled to each other according to an embodiment. FIG. 6 is an exploded perspective view of the cylinder and the piston according to an embodiment. FIG. 7 is an enlarged view of portion A of FIG. 5.

Referring to FIGS. 5 to 7, the cylinder 120 according to an embodiment may include the cylinder body 121 having an approximately cylindrical shape to form a first body end 121*a* and a second body end 121*b*, and the cylinder flange 125 that extend from the second body end 121*b* of the cylinder body 121 in the radial direction.

The first body end 121*a* and the second body end 121*b* form both ends of the cylinder body 121 with respect to the central portion 121*c* of the cylinder body 121 in an axial direction. The first body end 121*a* may define a rear end of the cylinder body 121, and the second body end 121*b* may define a front end of the cylinder body 121.

The cylinder body 121 may include a plurality of the gas inflows 122, through which at least a portion of the high-pressure gas refrigerant discharged through the discharge valve 161 may flow. A third filter 330 as a "filter member" may be disposed on the plurality of gas inflows 122.

Each of the plurality of gas inflows 122 may be recessed from the outer circumferential surface of the cylinder body 121 by a predetermined depth and width. The refrigerant may be introduced into the cylinder body 121 through the plurality of gas inflows 122 and the nozzle 123.

The introduced refrigerant may be disposed between the outer circumferential surface of the piston 130 and the inner circumferential surface of the cylinder 120 to serve as the gas bearing with respect to movement of the piston 130. That is, the outer circumferential surface of the piston 130 may be maintained in a state in which the outer circumferential surface of the piston 130 is spaced apart from the inner circumferential surface of the cylinder 120 by a pressure of the introduced refrigerant.

The plurality of gas inflows 122 may include first and second gas inflows 122*a* disposed on one or a first side with respect to the central portion 121*c* in an axial direction of the cylinder body 121, and a third gas inflow 122*c* disposed on the other or a second side with respect to the central portion 121*c* in the axial direction.

The first and second gas inflows 122*a* and 122*b* may be disposed at positions closer to the second body end 121*b* with respect to the central portion 121*c* in the axial direction of the cylinder body 121, and the third gas inflow 122*c* may be disposed at a position closer to the first body end 121*a* with respect to the central portion 121*c* in the axial direction of the cylinder body 121. That is, the plurality of gas inflows 122 may be provided in numbers that are not symmetrical to each other with respect to the central portion 121*c* in the axial direction of the cylinder body 121.

Referring to FIG. 6, the cylinder 120 may have a relatively high inner pressure at a side of the second body end 121*b*, which may be closer to a discharge-side of the compressed refrigerant, when compared to that of the first body end 121*a*, which may be closer to a suction-side of the refrigerant. Thus, more of the gas inflows 122 may be provided to or at the side of the second body end 121*b* to enhance a function of the gas bearing, and relatively less gas inflows 122 may be provided to or at the side of the first body end 121*a*.

The cylinder body 121 may further include the nozzle 123 that extends from the plurality of gas inflows 122 toward the inner circumferential surface of the cylinder body 121. Each nozzle 123 may have a width or size less than a width or size that of the gas inflow 122.

A plurality of the nozzle 123 may be provided along the gas inflow 122, which may extend in a circular shape. The plurality of nozzles 123 may be disposed to be spaced apart from each other.

Each nozzle 123 may include an inlet 123*a* connected to the gas inflow 122, and an outlet 123*b* connected to the inner circumferential surface of the cylinder body 121. Each nozzle 123 may have a predetermined length from the inlet 123*a* to the outlet 123*b*.

The refrigerant introduced into the gas inflow 122 may be filtered by the third filter 330 to flow into the inlet 123*a* of the nozzle 123, and then may flow toward the inner circumferential surface of the cylinder 120 along the nozzle 123. The refrigerant may be introduced into the inner space of the cylinder 120 through the outlet 123*b*.

The piston 130 may operate spaced apart from the inner circumferential surface of the cylinder 120, that is, may be lifted from the inner circumferential surface of the cylinder 120 by the pressure of the refrigerant discharged from the outlet 123*b*. That is, the pressure of the refrigerant supplied into the cylinder 120 may provide a lifting force or pressure to the piston 130.

The cylinder 120 may further include the first inclined portion 128 that extends backward at an incline from the cylinder body 121. The first inclined portion 128 may be inclined in a direction in which an outer diameter of the cylinder 120 gradually decreases. Thus, the cylinder 120 having the first inclined portion 128 may have an outer diameter less than an outer diameter of the cylinder body 121.

An end of the first inclined portion 128 may define an open end of the cylinder 120. The piston 130 may be inserted into the cylinder 120 through the open end of the cylinder 120.

In detail, the piston body 131 of the piston 130 may be inserted into the cylinder body 121, and the piston flange 132 may be disposed outside of the open end of the cylinder 120. The piston flange 132 may have a diameter greater than a diameter of the opened end of the cylinder 120.

Figure 8:
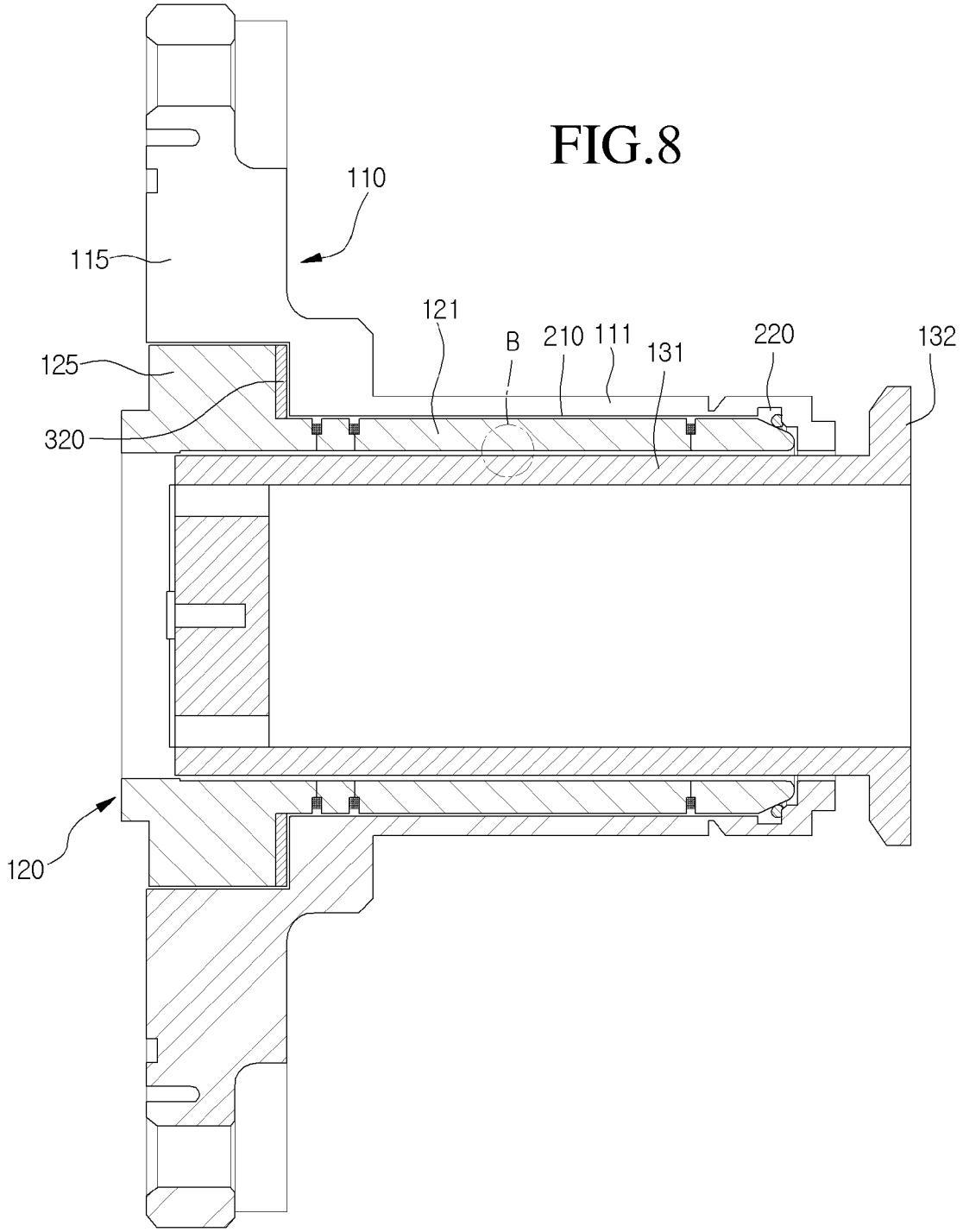
FIG. 8 is a cross-sectional view illustrating a state in which the cylinder and the piston are coupled to each other according to another embodiment.
Figure 9:
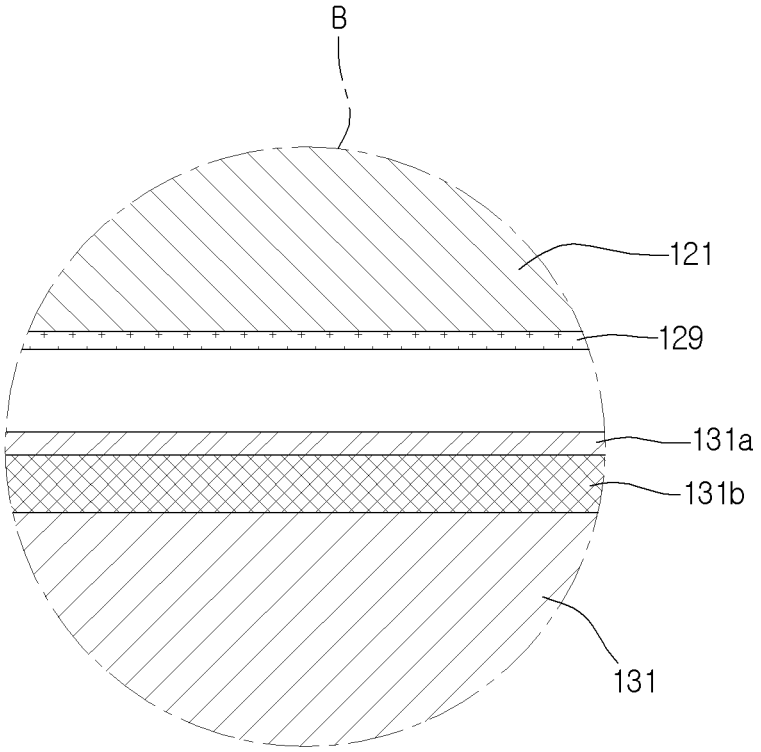
FIG. 9 is an enlarged view of portion B of FIG. 8.

FIG. 8 is a cross-sectional view illustrating a state in which the cylinder and the piston are coupled to each other according to an embodiment. FIG. 9 is an enlarged view of portion B of FIG. 8.

Referring to FIGS. 8 and 9, a flow space 210, through which at least a portion of the refrigerant discharged through the discharge valve 161 may flow, may be defined between the cylinder 120 and the frame 110. The flow space 210 may extend backward from a space between the cover coupling portion 115 of the frame 110 and the cylinder flange 125 of the cylinder 120 up to a space between a rear portion of the frame body 111 and the first body end 121*a* of the cylinder body 121. The refrigerant flowing into the flow space 210 may flow toward the inner circumferential surface of the cylinder 120 via the gas inflow(s) 122 and the nozzle(s) 123.

The linear compressor 100 may also include the sealing pocket 220 that communicates with the flow space 210 and in which on the sealing member 200 may be disposed. The sealing pocket 220 may be a space in which the sealing member 200 may be installed. The sealing pocket 220 may be defined between the inner circumferential surface of the frame body 111 and the outer circumferential surface of the cylinder body 121. The sealing pocket 220 may be defined in or at a rear side of the frame 110 and the cylinder 120. The sealing pocket 220 may have a flow cross-section area greater than a flow cross-section of the flow space 210 with respect to the flow direction of the refrigerant.

As the sealing member 200 may be disposed between the cylinder 120 and the frame 110 to seal the flow space 210, it may prevent the refrigerant in the flow space 210 from leaking outside of the frame 110. Also, when the sealing member 200 is movably provided in the sealing pocket 220, and the compressor operates to generate a flow of the refrigerant in the flow space 210, the sealing member 200 may press the cylinder 120 and the frame 110 to prevent the cylinder 120 from being deformed by a pressing force of the sealing member 200.

The piston 130 may be reciprocated within the cylinder 120. As described above, the refrigerant may be introduced into the cylinder 120 through the gas inflow(s) 122 and the nozzle(s) 123 to serve as a bearing with respect to the piston 130 between the outer circumferential surface of the piston 130 and the inner circumferential surface of the cylinder 120. While the piston 130 is reciprocated, a load or stress in the radial direction may be applied to the piston body 131. In such a process, a lightweight piston formed of an aluminum material may be worn. If the abrasion of the piston increases, a friction coefficient may increase, causing leaking of the refrigerant.

In this embodiment, the cylinder 120 and the piston 130 may be surface-treated to prevent the cylinder 120 or the piston 130 from being worn. A cylinder surface treatment 129 may be disposed on the inner circumferential surface of the cylinder body 121. Also, a piston surface treatment 131*a* and a buffer 131*b* may be disposed on the outer circumferential surface of the piston body 131. The buffer 131*b* may be disposed between a surface of the piston body 131 and the piston surface treatment 131*a*. The cylinder surface treatment 129 and the piston surface treatment 131*a* may be disposed to face each other. For convenience of description, the piston surface treatment 131*a* may be referred to as a "first surface treatment", and the cylinder surface treatment 129 may be referred to as a "second surface treatment".

The cylinder 120 may be fixed, and the piston 130 may be reciprocated at a high rate. Thus, to reduce abrasion of the piston 130, the piston 130 may have a surface hardness greater than a surface hardness of the cylinder 120. Thus, a surface hardness of the piston surface treatment 131*a* provided on the outer surface of the piston 130 may be greater than a surface hardness of the cylinder surface treatment 129 provided on the inner circumferential surface of the cylinder body 121.

For example, the cylinder surface treatment 129 may include an anodizing layer. A technology for forming the anodizing layer may be a processing technology in which an aluminum surface is oxidized by oxygen generated from a positive electrode when power is applied to aluminum that serves as the positive electrode to form an oxidized aluminum layer. The anodizing layer may have superior corrosion resistance and insulation resistance.

Also, the anodizing layer may have a surface hardness that varies according to a state or component of a coating material (basic material). For example, the anodizing layer may have a surface hardness of about 500 Hv to about 600 Hv, where "Hv" represents Vicker's hardness.

The piston surface treatment 131*a* may include diamond like carbon (DLC). The DLC may be understood as a material that has a thin film shape and is formed by electrically accelerating carbon ions or activated hydrocarbon molecules of plasma, which is a carbon-based new material, to impact the material onto a surface of an object.

The DLC may have a physical property similar to that of diamond. Also, the DLC may have high hardness and abrasion resistance and a low friction coefficient. As a result, the DLC may have superior lubricity. The DLC may have a surface hardness of about 2,000 Hv to about 2,200 Hv.

The buffer 131*b* may be disposed inside the piston surface treatment 131*a*. The buffer 131*b* may serve to buffer a load or stress applied to the piston 130. If the buffer 131*b* is not provided, the load or stress applied to the piston 130 may increase. Thus, the piston surface treatment 131*a* may be delaminated from the piston body 131. In particular, if the piston surface treatment 131*a* has a thin thickness, delamination may easily occur.

Thus, in this embodiment, the buffer 131*b* may be disposed on the outer surface of the piston body 131, and the piston surface treatment 131*a* may be disposed outside of the buffer 131*b*. Thus, adhesion between the piston body 131 and the piston surface treatment 131*a* may be improved to prevent the piston surface treatment 131*a* from being delaminated.

The buffer 131*b* may have a surface hardness less than the surface hardness of the piston surface treatment 131*a*. For example, the buffer 131*b* may be formed of a Nickel (Ni)-phosphorus (P) alloy material. The Ni—P alloy material may be formed on the outer surface of the piston body 131 through a nickel plating method and have a chemical composition ratio of about 90% to about 92% of nickel (Ni) and about 9% to about 10% of phosphorus (P).

The Ni—P alloy material may be improved in corrosion resistance and abrasion resistance and have superior lubricity. The Ni—P alloy material may have a surface hardness of about 600 Hv to about 700 Hv.

As the buffer 131*b* may have the surface hardness less than the surface hardness of the piston surface treatment 131*a*, a polishing process may be easily performed on the buffer 131*b*. Thus, adhesion between the buffer 131*b* and the piston surface treatment 131*a* may be improved.

The surface hardness of the piston surface treatment 131*a* may be referred to as a "first hardness value", the surface hardness of the buffer 131*b* may be referred to as a "second hardness value", and the surface hardness of the cylinder surface treatment 129 may be referred to as a "third hardness value".

Hereinafter, a method for processing a piston will be described.

Figure 10:
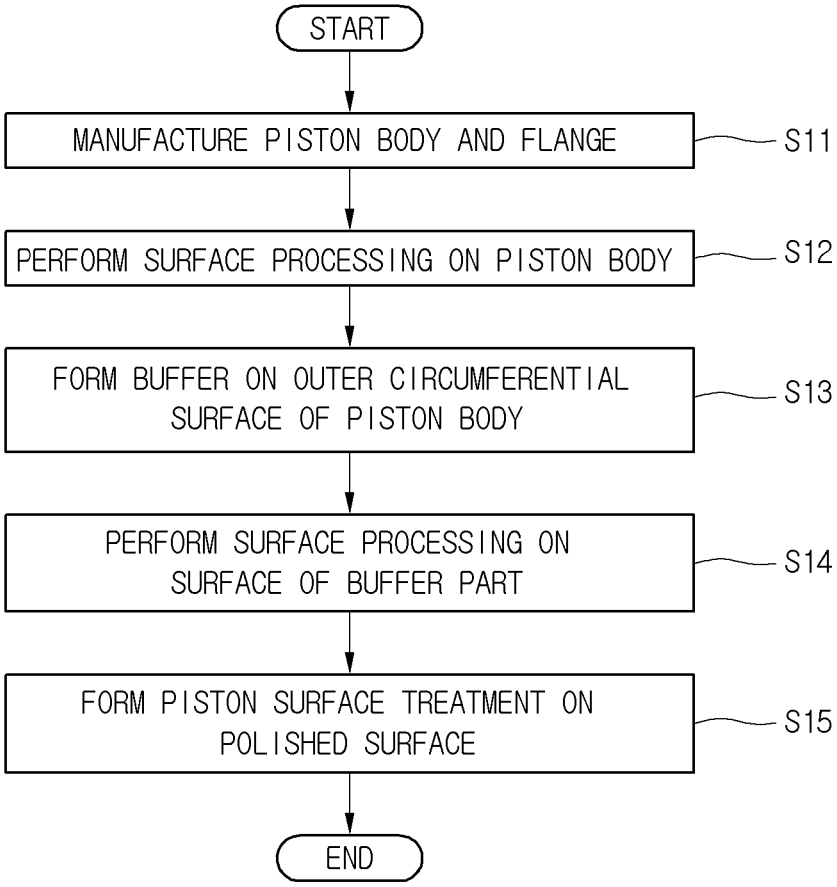
FIG. 10 is a flowchart of a method of manufacturing a piston of a linear compressor according to an embodiment.

FIG. 10 is a flowchart of a method of manufacturing a piston of a linear compressor according to an embodiment. Piston 130 including piston body 131 and piston flange 132 may be manufactured using aluminum or an aluminum alloy material, for example, in step S11. A surface of at least the piston body 131 of the piston 130 may be processed, in step S12. The surface processing of the piston body 131 may include a process of removing foreign substances generated when the piston is manufactured, or a process of polishing a rough surface, for example, a sandpaper process.

Buffer layer 131*b* may be formed on an outer circumferential surface of the processed piston body 131, in step S13. As described above, the buffer 131*b* may be formed through a plating process using a Ni—P alloy material, for example. The buffer 131*b* may have a sufficient thickness in consideration of the polishing process, which will be described hereinbelow, for example, a thickness of about 20 μm to about 25 μm.

After the buffer 131*b* is formed, a surface of the buffer 131*b* may be processed, for example, polished, in step S14. The polishing may be a process to planarize the buffer 131*b*, that is, maintain a flatness of the buffer 131*b* to a preset or predetermined level. The polishing process may include a chemical polishing process, an electrolyte polishing process, a belt polishing process, a chemical mechanical polishing process, or a magnetorheological finishing process, for example.

The chemical polishing process may be a process for polishing the buffer 131*b* in a state in which the buffer 131*b* is immersed in a mixing solution of a strong acid, such as a sulfuric acid, an acetic acid, or a hydrochloric acid, or a mixing solution of a strong alkali. The electrolyte polishing process may be a process for connecting the buffer 131*b* to a positive electrode within a specific electrolyte to cause metal elution, thereby selectively dissolving a protrusion on a surface of the buffer 131*b*.

The belt polishing process may be a process of rotating a polishing belt having a ring shape at a high rate to polish the buffer 131*b*, and the chemical mechanical polishing process may be a process of supplying slurry to chemically react on a surface of the buffer 131*b* in a state in which the buffer 131*b* is in contact with a surface of a polishing pad. The magnetorheological finishing process may be a process of polishing a surface of the buffer 131*b* using a magnetorheological finishing fluid controlled by a computer.

Through the above-described polishing process, the buffer 131*b* may be polished to a thickness of about 10 μm to about 15 μm, and a surface roughness of the buffer 131*b* may be maintained to a predetermined roughness (Rz=0.8 μm) or less. Rz may represent mean ten point mean height roughness.

As described above, the buffer 131*b* may have a thickness of about 10 μm or more. The buffer 131*b* may have a thickness greater than a thickness of the piston surface treatment 131*a* to perform a sufficient buffering function. In particular, as the piston 130 may be formed of an aluminum material, and thus, may be weak in rigidity, it is necessary to manufacture the piston 130 having a predetermined thickness (about 10 μm) at which aluminum is deformed by a predetermined load or stress. Thus, in this embodiment, the buffer 131*b* may have a thickness of about 10 μm or more.

As described above, as the buffer 131*b* has a smooth surface by the polishing process, uniform coating may be easily performed on the piston surface treatment 131. Also, even though a predetermined load is applied to the piston 130, the load may be uniformly distributed to prevent the piston surface treatment 131 from being delaminated.

The piston surface treatment 131*a* may be formed on the surface of the polished buffer 131*b*, in step S15. As described above, the piston surface treatment 131*a* may be formed by DLC coating and have a thickness of about 1 μm to about 3 μm. Also, the surface roughness of the piston surface treatment 131*a* may be maintained to predetermined roughness (Rz=0.8 μm) by the DLC coating (S15).

Although not shown, cylinder surface treatment 129 may be formed on the inner circumferential surface of the cylinder 120.

Figure 11A:
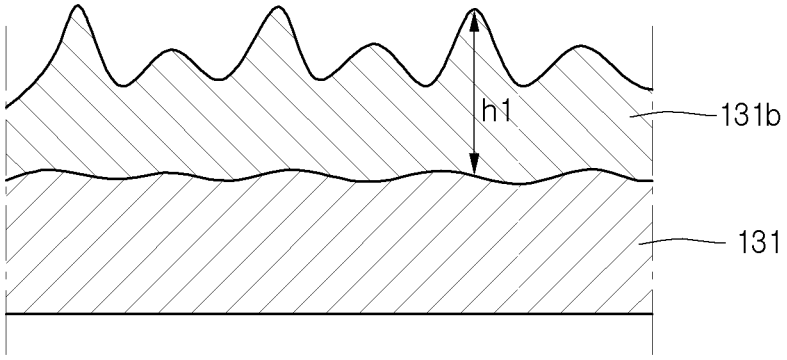
FIGS. 11A to 11C are views illustrating a surface treating process of a piston according to an embodiment.
Figure 11B:
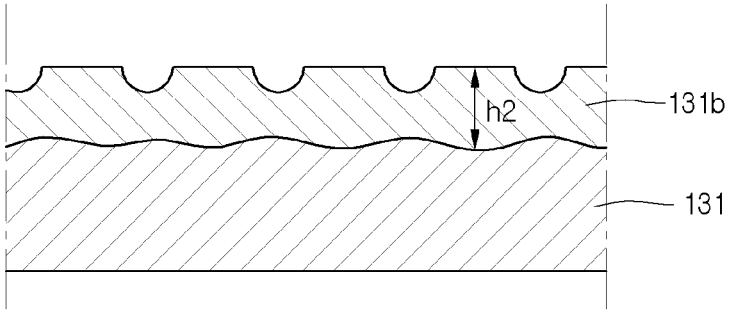
Figure 11C:
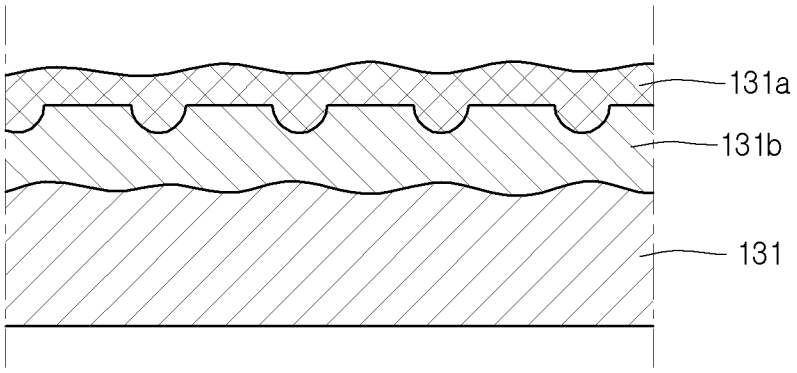

FIGS. 11A to 11C are views illustrating a surface treating process of a piston according to an embodiment. FIG. 11A illustrates a state in which the buffer 131*b* is disposed on a surface of the processed piston body 131. As described above, the buffer 131*b* may be formed through the plating process using a Ni—P alloy material. Before the polishing process, the buffer 131*b* may have a thickness h1 of about 20 μm.

Referring to FIG. 11B, the surface roughness of the buffer 131*b* may be maintained to a predetermined roughness (Rz=0.8 μm) or less by the polishing process. Also, the buffer 131*b* may have a thickness h2 of about 10 μm or more.

FIG. 11C illustrates a state in which the piston surface treatment 131*a* is disposed on the surface of the polished buffer 131*b*. As described above, the piston surface treatment 131*a* may be formed by the DLC coating and have a thickness of about 1 μm to about 3 μm. The surface roughness of the piston surface treatment 131*a* may be maintained to a predetermined roughness (Rz=0.8 μm) or less.

Hereinafter, a refrigerant flow while the linear compressor operates and an effect of the sealing member will be described hereinbelow.

Figure 12:
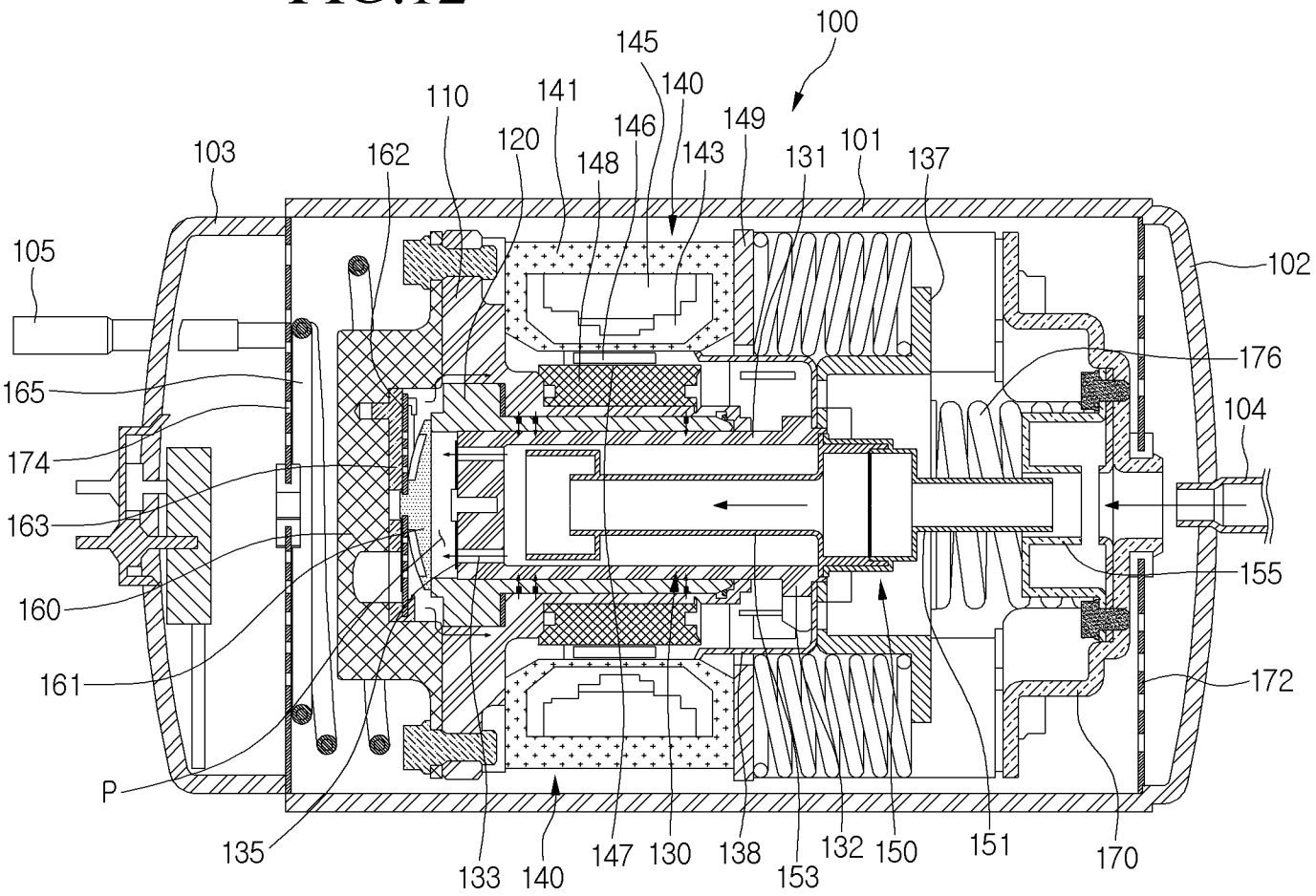
FIG. 12 is a cross-sectional view illustrating a refrigerant flow in the linear compressor according to an embodiment.

FIG. 12 is a cross-sectional view illustrating a refrigerant flow in the linear compressor according to an embodiment. Referring to FIG. 12, the refrigerant may be introduced into the shell 101 through the suction inlet 104 and flow into the suction muffler 150 through the suction guide 155.

The refrigerant may be introduced into the second muffler 153 via the first muffler 151 of the suction muffler 150 to flow into the piston 130. In this way, suction noise of the refrigerant may be reduced.

A foreign substance having a predetermined size (about 25 μm) or more, which is contained in the refrigerant, may be filtered while passing through the first filter 310 provided on or in the suction muffler 150. The refrigerant within the piston 130 after passing though the suction muffler 150 may be suctioned into the compression space P through the suction hole 133 when the suction valve 135 is opened.

When the refrigerant pressure in the compression space P is above the predetermined discharge pressure, the discharge valve 161 may be opened. Thus, the refrigerant may be discharged into the discharge space of the discharge cover 160 through the opened discharge valve 161, flow into the discharge outlet 105 through the loop pipe 165 coupled to the discharge cover 160, and be discharged outside of the compressor 100.

At least a portion of the refrigerant within the discharge space of the discharge cover 160 may flow into a space defined between the cylinder 120 and the frame 110, that is, the flow space 210. In detail, the refrigerant may flow toward the outer circumferential surface of the cylinder body 121 via the flow space 210 defined between the inner circumferential surface of the recess 117 and the outer circumferential surface of the cylinder flange 125 of the cylinder 120.

The refrigerant may pass through the second filter 320 disposed between the seat surface 127 of the cylinder flange 125 and the seat 113 of the frame 110. In this way, a foreign substance having a predetermined size (about 2 μm) or more may be filtered. Also, oil in the refrigerant may be adsorbed onto or into the second filter 320.

The refrigerant passing through the second filter 320 may be introduced into the plurality of gas inflows 122 defined in the outer circumferential surface of the cylinder body 121. While the refrigerant passes through the third filter 330 provided on or in the plurality of gas inflows 122, a foreign substances having a predetermined size (about 1 μm) or more, which is contained in the refrigerant, may be filtered, and the oil contained in the refrigerant may be adsorbed.

The refrigerant passing through the third filter 330 may be introduced into the cylinder 120 through the nozzle(s) 123 and flow between the inner circumferential surface of the cylinder 120 and the outer circumferential surface of the piston 130 to space the piston 130 from the inner circumferential surface of the cylinder 120 (gas bearing). The inlet 123*a* of each nozzle 123 may have a diameter greater than a diameter of the outlet 123*b*. Thus, a refrigerant flow section area of the nozzle 123 may gradually decrease with respect to the flow direction of the refrigerant. For example, the diameter of the inlet 123*a* may be two times greater than the diameter of the outlet 123*b*.

As described above, the high-pressure gas refrigerant may be bypassed within the cylinder 120 to serve as the gas bearing with respect to the piston 130, which is reciprocated, thereby reducing abrasion between the piston 130 and the cylinder 120. Also, as oil is not used for the bearing, friction loss due to the oil may not occur even though the compressor 100 operates at a high rate.

Also, as the plurality of filters may be provided on or in the passage of the refrigerant flowing in the compressor 100, foreign substances contained in the refrigerant may be removed. Thus, the refrigerant acting as the gas bearing may be improved in reliability. Thus, it may prevent the piston 130 or the cylinder 120 from being worn by the foreign substances contained in the refrigerant. Also, as the oil contained in the refrigerant is removed by the plurality of filters, friction loss due to oil may be prevented from occurring.

The refrigerant flowing into the flow space 210 may act on the sealing member 200. That is, a pressure of the refrigerant may act on the sealing member 200. Thus, the sealing member 200 may move within the sealing pocket 220 to seal a space between the cylinder 120 and the frame 110. Thus, it may prevent the refrigerant within the flow space 210 from leaking outside through the space between the cylinder 120 and the frame 110.

While the piston is reciprocated forward and backward, abrasion of the piston 130 may be prevented by the piston surface treatment 131*a* disposed on the piston 130. Also, the buffer 131*b* may reduce the load or stress applied to the piston 130. As a result, delamination of the piston surface treatment 131*a* from the surface of the piston 130 may be prevented, improving adhesion between the piston 130 and the piston surface treatment 131*a*.

According to embodiments disclosed herein, the compressor including inner components may decrease in size to reduce a volume of a machine room of a refrigerator and increase an inner storage space of the refrigerator. Also, the drive frequency of the compressor may increase to prevent performance of the inner components from being deteriorated due to the decreasing size thereof. In addition, as the gas bearing may be applied between the cylinder and the piston, a friction force occurring due to oil may be reduced.

Further, the surface treatment may be disposed on the outer circumferential surface of the piston to prevent the surface of the piston from being worn while the piston is reciprocated. More particularly, the piston may be formed of a soft material, such as aluminum or an aluminum alloy, allowing abrasion to occur. However, the surface treatment may be performed to prevent the abrasion from occurring.

Additionally, the buffer may be disposed between the outer circumferential surface of the piston and the surface treatment to reduce the load or stress applied to the piston and improve adhesion between the outer circumferential surface of the piston and the surface treatment, thereby preventing the surface treatment from being delaminated from the outer circumferential surface of the piston.

Further, while the buffer and the surface treatment are provided in the piston, the surface roughness may be maintained to a predetermined degree through the polishing process after the buffer is formed. Thus, adhesion of the surface treatment may be improved, and wear resistance may increase.

Furthermore, as the surface hardness of the surface treatment is sufficiently large, abrasion of the piston may be effectively prevented. Also, as the surface hardness of the buffer is less than the surface hardness of the surface treatment, the buffer may be easily polished to improve adhesion between the buffer and the surface treatment.

Also, as the surface treatment of the piston has a hardness sufficiently greater than a hardness of the inner circumferential surface of the cylinder, abrasion of the piston when the piston is reciprocated may be prevented.

Additionally, as the plurality of filtering device are provided in the compressor, foreign substances or oil contained in the compression gas (or discharge gas) introduced outside of the piston from the nozzle of the cylinder may be prevented from being introduced. More particularly, the first filter may be provided on the suction muffler to prevent the foreign substances contained in the refrigerant from being introduced into the compression chamber. The second filter may be provided on the coupling portion between the cylinder and the frame to prevent the foreign substances and oil contained in the compressed refrigeration gas from flowing into the gas inflow of the cylinder. The third filter may be provided on the gas inflow of the cylinder to prevent foreign substances and oil from being introduced into the nozzle of the cylinder from the gas inflow.

As described above, as foreign substances or oil contained in the compression gas that acts as the gas bearing may be filtered through or by the plurality of filtering device provided in the compressor and dryer, it may prevent the nozzle of the cylinder from being blocked by the foreign substances or oil. As the blocking of the nozzle of the cylinder may be prevented, a gas bearing effect may be effectively performed between the cylinder and the piston, and thus, abrasion of the cylinder and the piston may be prevented.

Embodiments disclosed herein provide a linear compressor in which abrasion of a piston may be prevented.

Embodiments disclosed herein provide a linear compressor that may include a shell including a suction inlet; a cylinder having a compression space, in which a refrigerant suctioned in through the suction inlet may be compressed; a piston reciprocated within the cylinder; a first surface treating part or treatment disposed on an outer surface of the piston, the first surface treating part having a first hardness value which is a measured hardness value; and a buffer part or buffer disposed between the outer surface of the piston and the first surface treating part, the buffer part having a second hardness value, which is a measured hardness value. The first hardness value of the first surface treating part may be greater than the second hardness value of the buffer part.

A second surface treating part or treatment disposed to face the first surface treating part of the piston and having a third hardness value, which is a measured hardness value, may be disposed on an inner circumferential surface of the cylinder. The first hardness value of the first surface treating part may be greater than the second hardness value of the second surface treating part.

The first surface treating part may be formed by being plasma-coated with diamond like carbon (DLC). The second surface treating part may include an anodizing layer. A nickel (Ni)-phosphorus (P) alloy material may be plated on the buffer part. The buffer part may have a thickness greater than a thickness of the first surface treating part.

The first surface treating part may have a thickness of about 1 μm to about 3 μm, and the buffer part may have a thickness of about 10 μm or more. The first surface treating part or the buffer part may have a surface rough of about 0.8 μm with respect to ten point mean height roughness (Rz).

Embodiments disclosed herein further provide a method of manufacturing a linear compressor that may include forming a buffer part or buffer on an outer circumferential surface of a piston; polishing the buffer part to maintain a surface roughness of the buffer part to a preset or predetermined roughness or less; and forming a piston surface treating part or treatment on a surface of the buffer part. The piston surface treating part may have surface hardness greater than a surface hardness of the buffer part.

The forming of the buffer part may include plating a nickel (Ni)-phosphorus (P) alloy material on the outer circumferential surface of the piston. The polishing process may include a chemical polishing process, an electrolyte polishing process, a belt polishing process, a chemical mechanical polishing process, or a magnetorheological finishing process, for example. The forming of the piston surface treating part may include performing plasma coating on the surface of the buffer part using diamond like carbon (DLC).

The method may further include forming an anodizing layer on an inner circumferential surface of the cylinder in which the piston is inserted.

The details of one or more embodiments are set forth in the accompanying drawings and description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell;

a cylinder having a compression space into which a refrigerant is suctioned and compressed;

a piston reciprocated within the cylinder, the piston being formed of an aluminum material;

a diamond like carbon (DLC) layer disposed on an outer circumferential surface of the piston;

an anodizing layer disposed on an inner circumferential surface of the cylinder that faces the DLC layer; and a buffer disposed between the outer circumferential surface of the piston and the DLC layer, the buffer consisting of a layer of nickel (Ni)-phosphorus (P) alloy material, the Ni—P alloy material having a chemical composition ratio of about 90% to about 92% of nickel (Ni) and about 9% to about 10% of phosphorus (P), wherein the DLC layer has a thickness of about 1 μm to about 3 μm and a surface roughness of about 0.8 μm with respect to ten point mean height roughness (Rz), and the layer of nickel (Ni)-phosphorus (P) alloy material has a thickness of about 10 μm to about 15 μm and a surface roughness of about 0.8 (Rz).

2. The linear compressor according to claim 1, wherein the cylinder is formed of the aluminum material.

3. The linear compressor according to claim 1, wherein the cylinder is formed of a material having a same thermal expansion coefficient as the piston.

4. The linear compressor according to claim 1, wherein the cylinder includes a cylinder body, and a cylinder flange that extends from the cylinder body in a radial direction of the cylinder.

5. The linear compressor according to claim 4, wherein the cylinder body includes a first body end, a central portion that extends from the first body end in an axial direction of the cylinder body, and a second body end that extends from the central portion in the axial direction of the cylinder body, such that the central portion of the cylinder body is disposed between the first end and the second end of the cylinder body.

6. The linear compressor according to claim 5, wherein the cylinder flange of the cylinder extends from the second body end of the cylinder body in the radial direction of the cylinder.

7. The linear compressor according to claim 5, wherein the cylinder body includes a plurality of gas inflows recessed from an outer circumferential surface of the cylinder body through which at least a portion of a high-pressure gas refrigerant discharged through a discharge valve from the compression space flows, and a plurality of nozzles that penetratingly extends from the plurality of gas inflows, in the radial direction of the cylinder, such that the portion of the high-pressure gas refrigerant is introduced between the outer circumferential surface of the piston and the inner circumferential surface of the cylinder, which forms a gas bearing with respect to movement of the piston.

8. The linear compressor according to claim 7, wherein a filter is provided in each of the plurality of gas inflows that filters the portion of the high-pressure gas refrigerant that flows through the plurality of gas inflows.

9. The linear compressor according to claim 7, wherein the plurality of nozzles is provided along the plurality of gas inflows, which extends in a circular shape and is spaced apart from each other.

* * * * *